US006444046B1

(12) United States Patent
Hillbrand

(10) Patent No.: US 6,444,046 B1
(45) Date of Patent: Sep. 3, 2002

(54) METHOD AND DEVICE FOR CLEANING RAILTRACK GROOVES

(75) Inventor: Georg Hillbrand, St. Florian (AT)

(73) Assignee: Florianer Bahn Forschungs-und Errichtungsgesellschaft mbH, St. Florian (AT)

( * ) Notice: Subject to any disclaimer, the term of this patent is extended or adjusted under 35 U.S.C. 154(b) by 0 days.

(21) Appl. No.: 09/331,632

(22) PCT Filed: Oct. 20, 1998

(86) PCT No.: PCT/EP98/06643

§ 371 (c)(1),
(2), (4) Date: Jun. 21, 1999

(87) PCT Pub. No.: WO99/20843

PCT Pub. Date: Apr. 29, 1999

(30) Foreign Application Priority Data

Oct. 20, 1997 (AT) ..... 1775/97

(51) Int. Cl.[7] ..... B08B 3/02

(52) U.S. Cl. ..... 134/34; 134/37; 134/104.4; 134/172; 104/279

(58) Field of Search ..... 134/23, 24, 34, 134/37, 10, 104.4, 172; 239/173, 174; 104/279; 15/55

(56) References Cited

U.S. PATENT DOCUMENTS

| | | | | |
|---|---|---|---|---|
| 490,269 A | * | 1/1893 | Chisholm | 239/173 |
| 893,878 A | * | 7/1908 | Shires | 239/173 |
| 4,230,045 A | * | 10/1980 | Fearon | 104/279 |
| 4,398,551 A | | 8/1983 | Moorehead | 134/104 |
| 4,781,121 A | * | 11/1988 | Kumar et al. | 104/279 |
| 5,673,626 A | * | 10/1997 | Jaeggi | 104/279 |
| 6,148,732 A | * | 11/2000 | Conway et al. | 104/279 |

FOREIGN PATENT DOCUMENTS

| | | | |
|---|---|---|---|
| FR | 378167 | 9/1907 | |
| FR | 2628457 | 9/1989 | |
| GB | 1459181 | * 12/1976 | 134/172 |

* cited by examiner

*Primary Examiner*—Randy Gulakowski
*Assistant Examiner*—Saeed Chaudhry
(74) *Attorney, Agent, or Firm*—Horst M. Kasper

(57) ABSTRACT

A groove cleaning unit has a high pressure jet nozzle from which a cleaning liquid impinges in a high pressure jet stream inclined downwardly onto a cleaning surface and is covered by a covering screen. An exit opening for the dirt liquid mixture is placed in the cover screen. The cover screen (5) covers a piece of a railtrack (17) with a railtrack groove (3). A high pressure jet nozzle (1) is placed in the region of a front wall (8) on the jet stream side. A high pressure liquid jet stream (2) is directed onto an impingement location (4) in the railtrack groove (3) by the high pressure jet nozzle (1). A reflected liquid jet stream (11) of the high pressure liquid jet stream (2) is reflected under an angle. The angle is steeper as compared to the inclination of a lower screen wall (7) disposed inclined relative to a travel advance direction (19) and is rising forwardly. The reflected liquid jet stream (11) passes essentially immediately to an exit opening (18).

26 Claims, 2 Drawing Sheets

METHOD AND DEVICE FOR CLEANING RAILTRACK GROOVES

BACKGROUND OF THE INVENTION

1. Field of the Invention

The invention relates to a method for the cleaning of rail grooves, in particular of railroad and tramway railtracks and to the device therefore, according to the preamble of the first method claim and of the first apparatus claim.

According to the known methods for the cleaning of railtrack grooves cleaning is performed with mechanical means, such as scratching chisel, wire brush and the like which leads to an insufficient cleaning effect or to a stripping at the railtrack grooves and to a difficult, in most cases insufficient, removal of the dirt layer, because the chisel size has to be adapted to different sizes of the rail grooves, the cleaning cannot be performed to the base of the grooves because of the water discharge openings in the rail grooves, whereby the method is associated with a small cleaning effect.

During the following separation and disposal of the carried out dirt, where the transport with a suctioned stream of air is expensive because the effective difference pressure cannot exceed one by and is also very energy expensive because of the large required volumes of air and nevertheless only a slight cleaning and thus only a small travel speed of a carrier vehicle is achievable relative to the high energy expenditure.

The stripped dirt is very abrasive and acts very corroding, whereby the suction device including the complicated constructed filter plant is subjected to heavy loading and requires the use of expensive materials and requires high maintenance costs in order to maintain the complete suction plant always sealed for vacuum.

In addition water jet streams are employed for street cleaning, which requires large volumes of water, which causes the flushing in of dirt, which frequently contains split or other flat waste parts such as foils, tissues or the like into the drainage channels of the railtrack grooves, which dirt then can cause stoppages there.

The cleaning with a high pressure jet stream of water or cleaning solution has been performed for cleaning of traffic areas, wherein the jet stream was placed onto a traffic area to be cleaned and the washed away dirt water mixture was then sucked off by a suction device from the surface to be cleaned and was discarded.

The directional accuracy of the high pressure jet stream does not have to be particularly high in this context and the high pressure jet stream does not have to be precisely adjusted and the case of an uncontrolled flowing off of the dirt water mixture carries little importance for the quality of the cleaning. The disadvantages of the suctioning off however are similar to those already described, wherein the wet dirt filtration takes the place of the dry dirt filtration.

SUMMARY OF THE INVENTION

1. Purposes of the Invention

It is an object of the present invention to furnish an improved method and a device, which aimingly and down to base ground accomplish in a reliable fashion specially the cleaning of the railtrack grooves of railroad and tramway railtracks while avoiding the described disadvantages with at least sufficient travel speed of the cleaning unit and under catching of the removed, in particular flushed out, dirt.

This object is obtained in connection with the method and the apparatus for performing the method with the features of the characterizing part of the method claim and of the first apparatus claim.

These claims and the subclaims form also simultaneously a part of the description of the invention.

2. Brief Description of the Invention

The method allows cleaning of a railtrack groove from a layer of dirt up to the base ground and to remove the layer of dirt also from the side faces of a railtrack grooves, wherein the dirt layer, in particular in case of a hydrodynamic impact, is infiltrated by the cleaning fluid based on the high pressure of the cleaning fluid and the dirt layer is ripped to pieces and entrained quickly and explosion like by penetration into hairline cracks and capillary chinks.

In this context a gaseous, vaporous, or liquid cleaning fluid or mixtures thereof or solutions can be employed, wherein liquids, in particular water containing mixtures are preferred.

A movable wall formed of rubber plates or the like can serve as a collection device, which leads to a suctioning as a guide device.

The supporting disposal of the used fluid together with the dirt by suctioning off is subject to the initially recited loads, nevertheless is possible, for example for the retooling of existing carrier vehicles.

The transport of the abraded dirt is performed by the kinetic energy contained in the fluid jet streams reflected from the stripping location, wherein the kinetic energy is hurled over a distance leading away upwardly from the railtrack surface into a collection trough, wherein the dirt fluid mixture is transported by a conveyor of conventional construction into a dirt container from the collection trough.

The application of a guide face for the dirt fluid mixture deflected from the impact and stripping location and disposed under favorable angle relative to the deflected dirt fluid mixture, results in a simple interference insensitive transfer device to collection trough.

The application of suitable materials is advantageous for improving the wettability, wherein cleaning speed can be increased with these materials.

The selection of the high pressure to be applied depends in addition to the distance between the high pressure jet nozzle and the impact location also on the form of the jet stream and on which region at a railtrack groove is to be captured simultaneously by the jet stream, this means also how far the jet stream can be spread apart, as well as according to the qualities, the holding together and the layer depth of the present dirt.

Similar considerations hold for the alignment of the high pressure fluid jet stream, with its inclination in the direction of travel and also perpendicular thereto, which alignment influences stripping of the dirt and therefore has to be accessible to an adjustment based on a change in position of the employed high pressure jet nozzle in its alignment, directly or through control devices if required in case of strongly varying properties of the dirt.

Based on the aiming application of a liquid high pressure fluid jet stream, the intended effect and the transport is accomplished with small pressure fluid volumes, whereby also the flushing in of dirt into the drainage boxes of the railtrack grooves is avoided and no large amounts of soiled fluid, usually water are generated, which have to be discharged. The amounts can be discharged for example in case of lawn railtracks between these railtracks or on the side of these railtracks, similarly like dirt composed of biomass and ground mass, such that for the disposal only the dirt remains generated in the road region, which becomes possible for example by storage for example in an interchangeable container, which serves as a dirt container.

It is an important advantage of the methods and of the applied device to furnish a wet treatment of the dirt, by way of which the dust development is suppressed by depositing in the fog droplets of the high pressure fluid jet stream, without that a separate expensive segregation and deposition would prove necessary.

The high pressure fluid jet stream has to be directed fairly precisely to the position to be cleaned during the cleaning of the railtrack grooves, an advantageous shape of the jet stream has to be produced, and a suitable region of the impact angle has to be maintained in order to achieve a quick and good effect.

The dirt water mixture possibly still running off on the railtrack can exit substantially without further cleaning or also can be received by a suction device in order to keep the soiling of surroundings and ground as low as possible, wherein a small and little expensive apparatus is sufficient.

For increasing in the capabilities and power of the cleaning, several groove cleaning units can be disposed successively on a carrier vehicle for each rail, whereby the cleaning and a thus traveling speed can approach the usual train transport speeds.

It is particularly advantageous to provide a planar formation of the lower screen wall of the groove cleaning unit and to have the start at the railtrack surface at a distance from the impingement location of the high pressure fluid jet stream, which distance is at least equal to or somewhat larger as compared to the flushing width of the rail grooves, such that larger volumes of cleaning fluid cannot exit through and under the groove sealing of the screen wall.

It is important for good sideways covering that the side walls reach down up to the surfaces of the railtrack and the leading edge and end in sealing beams, which sealing beams are disposed advantageously resting back at least one surface and sealing beams delimit on the sides flushing opening for the railtrack grooves and sealing beams extend over the length of the opening in order to prevent the exit in particular of hard parts and of liquid.

The application of massive steel plate of larger thickness is necessary for this purpose because of the substantial abrasion, which can improve the sealing relative to the surface of the railtrack or, respectively, of the guiding face with a planar lower sealing face or increases the sealing pressure with a bomb shaped lower sealing face and thereby favorably forms the sealing interface.

A height level shiftable support of the sealing beams is useful for the height level of heavily varying surfaces, however the arrangement thereby becomes more subject to interferences under the heavy load.

A further improvement of the sealing with a sliding sealing beam, that is in particular on the surface of the railtrack, is achieved by application of a fluid under pressure, wherein air is particularly advantageous, wherein the air exits from openings disposed at the lower face for generation of a cushion.

A very effective, durable and lasting, and simple seal is achieved on the side of the leading edge by disposing a brush of sufficient length and with a wear resistant construction at the side wall of the covering in a brush support, wherein the brush extends over the length of the sealing beam at the outer edge of the leading edge. Simultaneously, a limitation of excessive growth of weeds at the leading edge is achieved.

The composition of the bristles, in particular made of wear resistant plastic, and also the mixed applications together with metal bristles, row by row alternating or also only made of metal bristles is advantageous depending on the application situation.

The application of a groove sealing, which reaches between the side walls of the railtrack groove up to the dirt layer or to the floor of the grooves, is of particular advantage in case of frequently cleaned grooves for the sealing against te dirt fluid mixture or for the substantial minimizing of the dirt fluid mixture passing through under the edge of the lower screen wall, or cleaned the screen wall and to the dirt layer in the railtrack grooves, while otherwise the dirt layer itself becomes effective as a seal toward the front.

The application of a groove covering, reaching from the edge of the screen wall at the railtrack surface in the travel direction reaching forwardly serves the same purpose, wherein the length of the groove covering is determined by the height level of the dirt layer deposited in the railtrack groove.

A particularly good cleaning back can be obtained in the region of the side wall of the railtrack groove, for example of the travel edge, can be achieved with a cross inclination of the high pressure fluid jet stream and is direct toward the side wall of the railtrack groove in case of heavily soiled side walls of the railtrack groove.

An effective cleaning of drainage openings up to the ground is made possible in addition by the high pressure fluid jet stream.

The spent cleaning fluid, from which the dirt has deposited up to the finest particles, can be already derived from the collection trough of the transport device on the railtrack space cleaned and next to the railtracks, in particular in case of long railtracks, similar like the top standing fluid from the dirt container, while the fluid volume generated during the passing over of the tramway railtracks is stored in a container and delivered for proper disposal.

The disposition of the groove cleaning unit at a small distance relative to wheel sets running in front of and behind or the disposition of guide wheels running in the preceding groove and there behind results in a particularly good guiding the groove, in particular in case of a curved track.

The disposition of a bucket chain in the mode of application protected is of advantage for running off the dirt water mixture, which arrangement of a bucket chain is associated with a high degree of effectiveness and which can be led upwardly on the outside close to the wall of the vehicle and which allows a simple transfer into a high level collection container.

It is advantageous to attach a magnetic collection device, known in principle, in front of each railtrack groove cleaning unit for the collection and removal of steel residues, in particular ships, of the railtrack and rails and other sources.

BRIEF DESCRIPTION OF THE DRAWINGS

The invention is described by way of a schematic drawing of an embodiment of the apparatus.

There is shown in.

DESCRIPTION OF INVENTION AND PREFERRED EMBODIMENT

Figure 1:
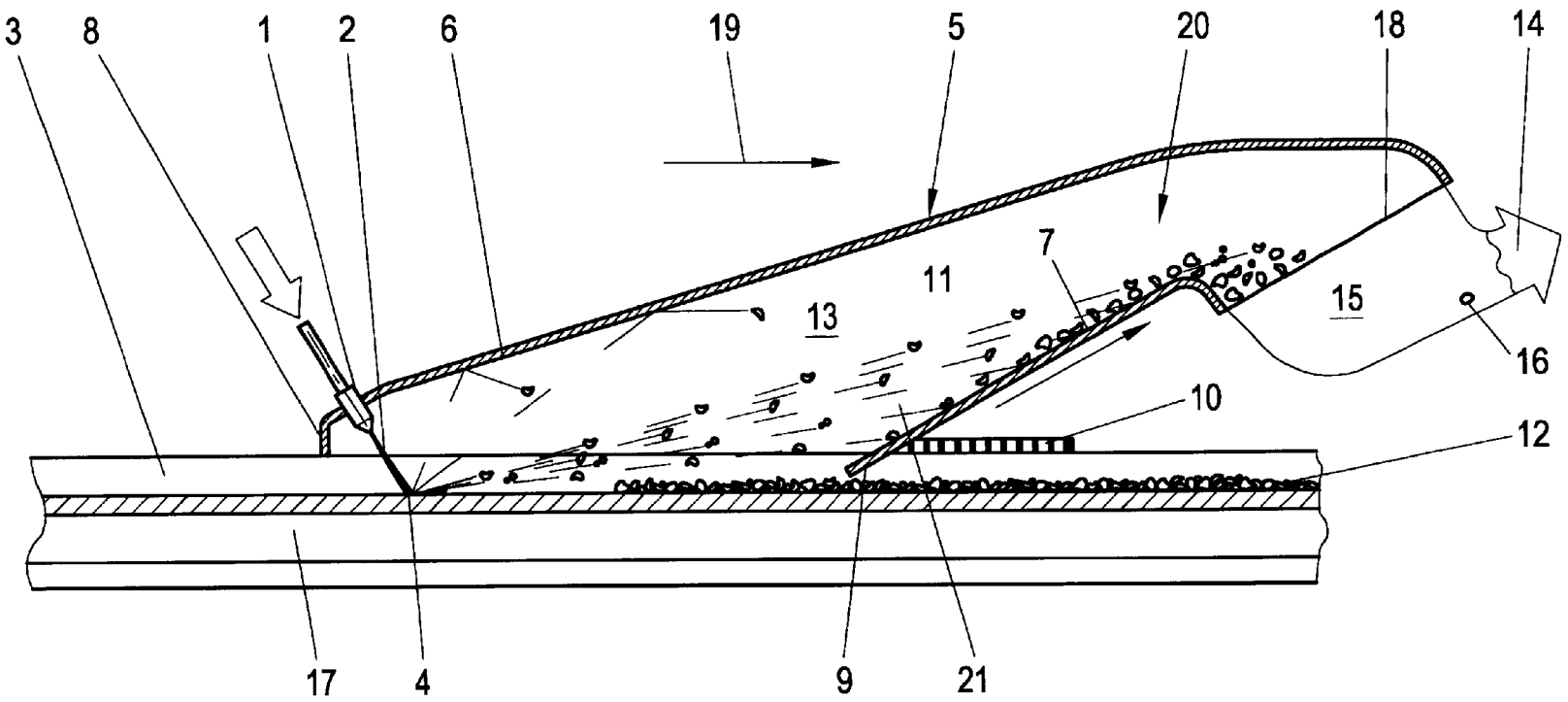
FIG. 1 the device in a schematic longitudinal section.

A cover screen 5 of the groove cleaning unit is disposed on a railtrack 17 with incorporated rail groove 3, wherein the rail groove 3 grips over the rail groove on two sides at a small distance, wherein the groove cleaning unit is guided in this working position by the support of a carrier vehicle not illustrated, for example with guide wheels running ahead and/or behind.

The cover screen 5 comprises side walls 13, a front wall 8, a lower screen wall 7 also disposed on the front side, and an upper screen wall 6.

A high pressure jet nozzle is disposed in the region of the jet stream side front wall 8 at a distance above the railtrack 17, wherein the high pressure fluid jet stream 2 of the high pressure jet nozzle 1, comprising water as a cleaning fluid, is disposed flying in travel advance direction 19 forwardly and downward, about under 60 angle degrees relative surface of the railtrack and wherein the high pressure fluid jet stream 2 impinges the floor of the railtrack groove 3 at the impingement location 4 of the railtrack groove 3.

The dirt stripped by the high pressure fluid jet stream 2 from the dirt layer 12 in the railtrack groove 3 is carried along by the flowing of reflected fluid jet stream 11 under a flatter angle relative to the surface of the railtrack.

The dirt fluid mixture is hurled by the kinetic energy contained in the fluid jet stream primarily against the lower planar formed screen wall 7, which screen wall 7 is disposed under a steeper angle as compared to the angle under which the reflected fluid jet streams impinge and the dirt fluid mixture is led upwardly at the screen wall 7 until the dirt fluid mixture exits through an exit opening 18.

This exit opening 18 is left free by the discharge channel 20 exhibiting at most about the width of the railtrack 17 and formed by the lower screen wall 7, the two side walls 13 and the upper screen wall 6, wherein the fluid jet streams or, respectively, the dirt fluid mixture passes through the discharge channel 20 into a collection trough 15, wherein the fluid jet streams or, respectively the dirt fluid mixture are either stored in the collection trough 15 and later on discharged or subjected further treatment.

A part of the used cleaning fluid separates in the collection trough 15 during further treatment and then streams through an overflow and is led either directly between and/or next to the railtracks or is led to another storage container not illustrated.

The remaining part of the dirt fluid mixture is fed by a transport device of conventional construction only indicated, for example an Archimedean spiral or conveyor belt or a bucket chain or the like into a collection container a further separation and discharge of fluid and dirt.

The lower screen wall 7 ends at the bottom in a planar edge 21, wherein a groove seal 9 can be placed at the planar edge 21, wherein the groove seal 9 can be either hinged or elastic, made of rubber or the like, wherein the groove seal 9 reaches in the rail groove 3 up to the dirt deposit 12 and seals against passage of the scouring fluid jet stream.

A groove cover 10 is disposed on the rail groove 3 over a multiple of the depth of the rail groove 3 starting at the edge 21 of the lower screen wall 7 and running forwardly in travel direction 19, wherein the groove covering 10 covers the surface of the railtrack 17 and seals additionally against passage of the flushing jet stream under the groove seal.

Figure 2:
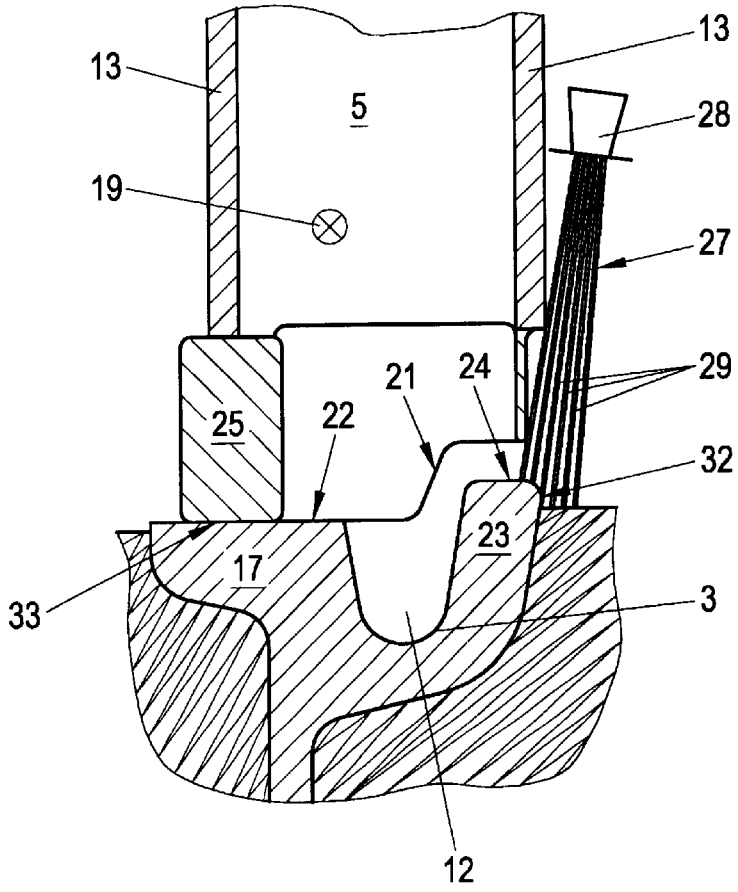
FIG. 2 the device according to FIG. 1 in a cross-sectional view.

The covering screen 5 is illustrated in cross-section and at a right angle relative to the travel direction 19 in FIG. 2.

The bristles 29 of the sealing brush 27 exhibit at least five times the length of the maximum permissible height level distance between the surfaces 22 and 24 of the railtrack 17 and of the leading edge 23 and comprise for example wear resistant plastic, which bristles 29 can be arranged forming alternating rows with metal wire bristles.

The bristles 29 scrub over the outer edge 32 of the leading edge and rest at the outside of the sealing beam 26 from below.

Figure 3:
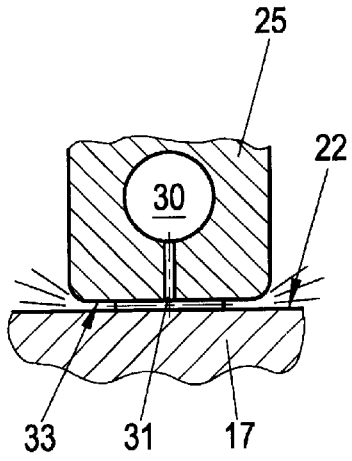
FIG. 3 to section with the sealing beam in FIG. 2 with fluid flushing.

An air flushing is reproduced in FIG. 3 for the sealing beam 25 led with the lower planar sealing face 33 of the vehicle always at a very narrow distance or resting on the surface 22 of the railtrack 17. One or several longitudinal slots 31 disposed successively or bore holes opened up to the lower sealing face 33 reach from a longitudinal bore 30 in the sealing beam 25, wherein the air exits with a pressure of from one to 10 bar at the lower sealing face 33, and wherein the penetration of dirt between the sealing face 33 and the surface 22 of the rail 17 is prevented and thereby the surface 22 of the rail 17 is maintained clean.

What is claimed as new and desired to be protected by Letters Patent is set forth in the appended claims.

What is claimed is:

1. A method for cleaning of railtrack grooves, during travel with a cleaning unit attached to a carrier vehicle, and disposed in an essentially fixed position relative railtrack groove, disposing a sealing beam (25) resting on a surface (22) of a railtrack (17) and essentially laying on the surface (22);

wherein a high pressure aqeous liquid jet stream (2) of a cold or heated aqueous cleaning liquid is directed at a dirt layer (12) in the railtrack groove (3) to be processed by a groove cleaning unit, wherein a reflected liquid jet stream (11) of the high pressure aqueous liquid jet stream (2) reflected by a respective impact location (4) entrains the dirt and a dirt liquid mixture fed from a collection device and from a guide device to a transport apparatus, wherein the dirt liquid mixture is guided into a dirt collection device and stored or spent liquid is at least partially separated from the dirt in the dirt collection device or in a separate separation device or the dirt liquid mixture is directly carried out.

2. The method for cleaning of railtrack grooves, according to claim 1, wherein the high pressure aqueous liquid jet stream (2) directed toward the dirt layer (12) in the railtrack groove (3) to be processed by the groove cleaning unit is arranged with an impingement angle relative to the railtrack surface of from between 30 and 80 angular degrees relative to the surface of the railtrack (17), depending on the kind of the high pressure aqueous liquid jet stream (2), on the dirt in the dirt layer (12) of railtrack grooves (3) and on a travel speed.

3. The method for cleaning of rail grooves according to claim 1, wherein the high pressure aqueous liquid jet stream (2) directed by a groove cleaning unit onto the dirt deposit (12) in the railtrack groove (3) to be processed is arranged with an impingement angle relative to the railtrack surface, perpendicular to a travel direction (19) of the carrier vehicle and thus essentially perpendicular to the longitudinal direction of the railtrack groove (3), of between 90 and 30 angular degrees relative to the surface of the railtrack (17), directed against a side wall of the railtrack groove (3), depending on the kind of the high pressure aqueous liquid jet stream (2), of the dirt in the dirt deposits (12) of the railtrack groove (3).

4. The method for cleaning of railtrack grooves according to claim 1 wherein the high pressure aqueous liquid jet stream (2), formed as a forwardly and downwardly inclined jet stream in travel direction (19), in particular as a flat jet stream directed in particular perpendicular to the railtrack groove (3) is directed to a dirt deposit (12) in the railtrack groove (3) and an aqueous liquid jet stream reflected under an acute angle upwardly impinges on the guide face (7) and is deflected along the guide space (7) forwardly and upwardly.

5. The method for cleaning of railtrack grooves, according to claim 1, wherein reflected aqueous liquid jet streams (11) of the high pressure aqueous liquid jet stream (2) of a cleaning liquid, in particular water or aqueous cleaning solution, directed by the groove cleaning unit onto a dirt deposit (12) in the railtrack groove (3) to be processed, entrain dirt from the respective impingement locations (4) and transport the dirt over a guide surface at an inclined angle upwardly and are collected in a collection device together with the dirt, wherein in particular at least the overwhelming part of the solid parts and of a fluid content are directly carried out or are led with a transport device (14) into a dirt collection device.

6. The method for cleaning of railtrack grooves according to claim 1, wherein a material for decreasing of the surface tension is added to the cleaning fluid of the high pressure fluid jet stream (2).

7. The method for cleaning of railtrack grooves according to claim 1 wherein the cleaning liquid of the high pressure aqueous liquid jet stream (2) is splashed onto the dirt deposit (12) with a working pressure of between 10 bar and 2500 bar depending on the kind of the cleaning liquid, of the dirt deposit (12) and the jet stream expansion required and occurring during the cleaning.

8. A groove cleaning unit with a high pressure jet nozzle from which a cleaning liquid impinges in a high pressure jet stream inclined downwardly onto a cleaning surface and is covered by a covering screen, wherein an exit opening for the dirt liquid mixture is placed in the cover screen, wherein the cover screen (5) covers a piece of a railtrack (17) with a railtrack groove (3), a sealing beam (25) resting on a surface (22) of a railtack (17) and essentially laying on the surface (22), wherein a high pressure jet nozzle (1) is placed in the region of a front wall (8) on the jet stream side, wherein a high pressure liquid jet stream (2) is directed onto an impingement location (4) in the railtrack groove (3) by the high pressure jet nozzle (1), wherein a reflected liquid jet stream (11) of the high pressure liquid jet stream (2) is reflected under an angle, wherein the angle is steeper as compared to the inclination of a lower screen wall (7) disposed inclined relative to a travel advance direction (19) and is rising forwardly and wherein the reflected liquid jet stream (11) passes essentially immediately to an exit opening (18) or that the reflected liquid jet streams (11) are deflected under an angle, wherein the angle is equal to or flatter as compared to the inclination of the forwardly rising disposed lower screen wall (7), wherein the reflected liquid jet streams (11) are captured and pass through the exit opening (18) at the surface of the lower screen wall (7).

9. The groove cleaning unit according to claim 8, wherein the lower screen wall (7) forms a discharge channel (20) with an upper stream wall (6) and side walls (13) disposed on two sides, wherein the discharge channel (20) ends in the exit opening (18), wherein the discharge channel (20) exhibits at the railtrack surface at least the width of a railtrack groove (3) and exhibits upwardly the same, or an increasing width.

10. The groove cleaning unit according to claim 8 wherein the high pressure jet nozzle (1) is at least in travel direction (19) steeper or flatter inclined downwardly and adjustable in distance relative to the impingement location, depending on the kind and the quantity of the dirt deposit (12) in the railtrack groove (3), the respective travel speed and the pressure of the high-pressure liquid jet stream (2) and wherein the high-pressure liquid jet stream (2) is directed by the high pressure jet nozzle (1), as a flat jet stream with a width perpendicular to the direction of travel (19) and essentially is delivered impinging over the width of the railtrack groove (3), wherein an angle of between 30 and 80 angular degrees is adjustable relative to the surface of the railtrack (17).

11. The groove cleaning unit according to claim 8 wherein the high-pressure jet nozzle (1) is adjustable perpendicular to the travel direction (19), sideways, perpendicular or steeper or flatter inclined, depending on the groove shape, the kind and amount of the dirt deposit (12) in the railtrack groove (3) in order to direct high-pressure fluid jet streams (2) preferably sideways at a side wall of the railtrack groove (3).

12. The groove cleaning unit according to claim 8 wherein the exit opening (18) of the cover screen (5) leads into a collection trough (15), wherein the collection trough forms at the same time a storage container or is this feeding part of a transport device (14), from which the dirt is transported with the cleaning liquid or a part of the cleaning liquid into a dirt container, wherein the cleaning liquid with a mud part discharges toward the outside from the dirt container or passes into a storage container.

13. The groove cleaning unit according to claim 8 wherein a collection trough (15) for the dirt cleaning liquid mixture is furnished with an overflow (16) at least for the overwhelming part of the spent cleaning liquid part.

14. The groove cleaning unit according to claim 8 wherein the groove cleaning unit is placed immediately between wheel sets coordinated as close as possible to the groove cleaning unit or is placed directly in guide wheels running in the groove and wherein a separate groove cleaning unit is provided for each railtrack groove (3) of a railtrack strand.

15. A groove cleaning unit with a high pressure jet nozzle from which a cleaning fluid impinges in a high pressure jet stream inclined downwardly onto a cleaning surface and is covered by a covering screen, wherein an exit opening for the dirt fluid mixture is placed in the cover screen, wherein the cover screen (5) covers a piece of a railtrack (17) with a railtrack groove (3), wherein a high pressure jet nozzle (1) is placed in the region of a front wall (8) on the jet stream side, wherein a high pressure fluid jet stream (2) is directed onto an impingement location (4) in the railtrack groove (3) by the high pressure jet nozzle (1), wherein a reflected fluid jet stream (11) of the high pressure fluid jet stream (2) is reflected under an angle, wherein the angle is steeper as compared to the inclination of a lower screen wall (7) disposed inclined relative to a travel advance direction (19) and is rising forwardly and wherein the reflected fluid jet stream (11) passes essentially immediately to an exit opening (18) or that the reflected fluid jet streams (11) are deflected under an angle, wherein the angle is equal to or flatter as compared to the inclination of the forwardly rising disposed lower screen wall (7), wherein the reflected fluid jet streams (11) are captured and pass through the exit opening (18) at the surface of the lower screen wall (7); wherein the lower screen wall (7) forms a discharge channel (20) with an upper stream wall (6) and side waits (13) disposed on two sides, wherein the discharge channel (20) ends in the exit opening (18), wherein the discharge channel (20) exhibits at the railtrack surface at least the width of a railtrack groove (3) and exhibits upwardly the same, or an increasing width;

wherein the side walls (13) reach down up to the surface (24) of the railtrack (17) and to a surface of a leading edge (23) on two sides of the railtrack groove (3) and end with sealing beams (25,26), wherein a sealing beam (25) is the disposed resting on a surface (22) of the railtrack (17) essentially laying on the surface (22) and wherein the sealing beam (26) is disposed resting on the surface (24) of the leading edge (23), in the case the high level distance between the surface (22) of the railtrack (17) and of the surface of the leading edge (23) exhibits the highest tolerance value, wherein the two sealing beams (25, 26) delimit the opening of the cover screen (5) sideways relative to the railtrack groove (3) and protrude in the direction of travel (19), preferably on two sides.

16. The groove cleaning unit according to claim 15 wherein the lower screen wall (7), which preferably exhibits a planar course, is reaching down to the surface of the processed railtrack (17) and ends in an edge (21) preferably nearly touching at least at a distance from the impingement point (4) of the high-pressure fluid jet streams, wherein the distance corresponds at least approximately to the length of the railtrack groove (3) processed by the high-pressure fluid jet stream.

17. The groove cleaning unit according to claim 15 wherein wherein the high pressure aqueous liquid jet stream (2) directed toward a dirt layer (12) in the railtrack groove (3) to be processed by the groove cleaning unit is arranged with an impingement angle relative to the railtrack surface of from between 30 and 80 angular degrees relative to the surface of the railtrack (17), depending on the kind of the high pressure aqueous liquid jet stream (2), on the dirt in the dirt layer (12) of railtrack grooves (3) and on a travel speed;

wherein the high pressure aqueous liquid jet stream (2) directed by a groove cleaning unit onto the dirt deposit (12) in the railtrack groove (3) to be processed is arranged with an impingement angle relative to the railtrack surface, perpendicular to a travel direction (19) of the carrier vehicle and thus essentially perpendicular to the longitudinal direction of the railtrack groove (3), of between 90 and 30 angular degrees relative to the surface of the railtrack (17), directed against a side wall of the railtrack groove (3), depending on the kind of the high pressure aqueous liquid jet stream (2), of the dirt in the dirt deposits (12) of the railtrack groove (3).

18. A groove cleaning unit with a high pressure jet nozzle from which a cleaning fluid impinges in a high pressure jet stream inclined downwardly onto a cleaning surface and is covered by a covering screen, wherein an exit opening for the dirt fluid mixture is placed in the cover screen, wherein the cover screen (5) covers a piece of a railtrack (17) with a railtrack groove (3), wherein a high pressure jet nozzle (1) is placed in the region of a front wall (8) on the jet stream side, wherein a high pressure fluid jet stream (2) is directed onto an impingement location (4) in the railtrack groove (3) by the high pressure jet nozzle (1), wherein a reflected fluid jet stream (11) of the high pressure fluid jet stream (2) is reflected under an angle, wherein the angle is steeper as compared to the inclination of a lower screen wall (7) disposed inclined relative to a travel advance direction (19) and is rising forwardly and wherein the reflected fluid jet stream (11) passes essentially immediately to an exit opening (18) or that the reflected fluid jet streams (11) are deflected under an angle, wherein the angle is equal to or flatter as compared to the inclination of the forwardly rising disposed lower screen wall (7), wherein the reflected fluid jet streams (11) are captured and pass through the exit opening (18) at the surface of the lower screen wall (7);

wherein the lower screen wall (7) forms a discharge channel (20) with an upper stream wall (6) and side walls (13) disposed on two sides, wherein the discharge channel (20) ends in the exit opening (18), wherein the discharge channel (20) exhibits at the railtrack surface at least the width of a railtrack groove (3) and exhibits upwardly the same, or an increasing width;

wherein at least a sealing beam (25) resting on a surface (22) at the railtrack (17) exhibits a steel plate several mm thick and exhibiting a thickness of from 10 to 50 min exhibits a profile with a planar or bomb shaped lower sealing face (33) and exhibits a rectangular or square cross-section.

19. A groove cleaning unit with a high pressure jet nozzle from which a cleaning fluid impinges in a high pressure jet stream inclined downwardly onto a cleaning surface and is covered by a covering screen, wherein an exit opening for the dirt fluid mixture is placed in the cover screen, wherein the cover screen (5) covers a piece of a railtrack (17) with a railtrack groove (3), wherein a high pressure jet nozzle (1) is placed in the region of a front wall (8) on the jet stream side, wherein a high pressure fluid jet stream (2) is directed onto an impingement location (4) in the railtrack groove (3) by the high pressure jet nozzle (1), wherein a reflected fluid jet stream (11) of the high pressure fluid jet stream (2) is reflected under an angle, wherein the angle is steeper as compared to the inclination of a lower screen wall (7) disposed inclined relative to a travel advance direction (19) and is rising forwardly and wherein the reflected fluid jet stream (11) passes essentially immediately to an exit opening (18) or that the reflected fluid jet streams (11) are deflected under an angle, wherein the angle is equal to or flatter as compared to the inclination of the forwardly rising disposed lower screen wall (7), wherein the reflected fluid jet streams (11) are captured and pass through the exit opening (18) at the surface of the lower screen wall (7);

wherein at the sealing beam (26), preferably however the two sealing beams (25, 26) are disposed at the coordinated side wall (13) of the cover screen (5) shiftable in height level.

20. A groove cleaning unit with a high pressure jet nozzle from which a cleaning fluid impinges in a high pressure jet stream inclined downwardly onto a cleaning surface and is covered by a covering screen, wherein an exit opening for the dirt fluid mixture is placed in the cover screen, wherein the cover screen (5) covers a piece of a railtrack (17) with a railtrack groove (3), wherein a high pressure jet nozzle (1) is placed in the region of a front wall (8) on the jet stream side, wherein a high pressure fluid jet stream (2) is directed onto an impingement location (4) in the railtrack groove (3) by the high pressure jet nozzle (1), wherein a reflected fluid jet stream (11) of the high pressure fluid jet stream (2) is reflected under an angle, wherein the angle is steeper as compared to the inclination of a lower screen wall (7) disposed inclined relative to a travel advance direction (19) and is rising forwardly and wherein the reflected fluid jet stream (11) passes essentially immediately to an exit opening (18) or that the reflected fluid jet streams (11) are deflected under an angle, wherein tie angle is equal to or flatter as compared to the inclination of the forwardly rising disposed lower screen wall (7), wherein the reflected fluid jet streams (11) are captured and pass through the exit opening (18) at the surface of the lower screen wall (7);

wherein a sealing beam (25) is disposed on a surface (22) of the railtrack (17), is furnished with a longitudinal bore hole (30), wherein the longitudinal bore hole (30) is connected to a feed line for a fluid under pressure and wherein the feed line ends with one or several longitudinal slots (31) aligned in travel direction (19) or a plurality of bore holes, opened downwardly and being in the lower disposed sealing face (33).

21. A groove cleaning unit with a high pressure jet nozzle from which a cleaning fluid impinges in a high pressure jet stream inclined downwardly onto a cleaning surface and is covered by a covering screen, wherein an exit opening for the dirt fluid mixture is placed in the cover screen, wherein the cover screen (5) covers a piece of a railtrack (17) with a railtrack groove (3), a sealing beam (25) resting on a surface (22) of a railtrack (17) essentially laying on the surface (22), wherein a high pressure jet nozzle (1) is placed in the region of a front wall (8) on the jet stream side, wherein a high pressure fluid jet stream (2) is directed onto an impingement location (4) in the railtrack groove (3) by the high pressure jet nozzle (1), wherein a reflected fluid jet stream (11) of the high pressure fluid jet stream (2) is reflected under an angle, wherein the angle is steeper as compared to the inclination of a lower screen wall (7) disposed inclined relative to a travel advance direction (19) and is rising forwardly and wherein the reflected fluid jet stream (11) passes essentially immediately to an exit opening (18) or that the reflected fluid jet streams (11) are deflected under an angle, wherein the angle is equal to or flutter as compared to the inclination of the forwardly rising disposed lower screen wall (7), wherein the reflected fluid jet streams (11) are captured and pass through the exit opening (18) at the surface of the lower screen wall (7);

wherein a sealing brush (27) is disposed in a brush support (28), horizontally inserted, is disposed sideways outside of the sealing beam (26), at the side of a leading edge (23), next to a side wall (13) in travel direction or, respectively, working direction (19), wherein the bristles (29) are aligned from top to bottom and scrubbingly end over an outer edge (23) of the leading edge (23) and exhibit a length, which amounts to a multiple, and at least a five fold of the largest allowable distance between the sealing beam (26) and the surface (24) of the leading edge (53), wherein the sealing brush (27) covers the length of the sealing beam (26) in travel direction (19) and preferably surpasses.

22. The groove cleaning unit according to claim 21 wherein bristles (29) of a brush (27) are made of plastic of a high wear resistance and or are reinforced with metal bristles, which metal bristles are preferably disposed in rows and disposed mixed.

23. A groove cleaning unit with a high pressure jet nozzle from which a cleaning fluid impinges in a high pressure jet stream inclined downwardly onto a cleaning surface and is covered by a covering screen, wherein an exit opening for the dirt fluid mixture is placed in the cover screen, wherein the cover screen (5) covers a piece of a railtrack (17) with a railtrack groove (3), wherein a high pressure jet nozzle (1) is placed in the region of a front wall (8) on the jet stream side, wherein a high pressure fluid jet stream (2) is directed onto an impingement location (4) in the railtrack groove (3) by the high pressure jet nozzle (1), wherein a reflected fluid jet stream (11) of the high pressure fluid jet stream (2) is reflected under an angle, wherein the angle is steeper as compared to the inclination of a lower screen wall (7) disposed inclined relative to a travel advance direction (19) and is rising forwardly and wherein the reflected fluid jet stream (11) passes essentially immediately to an exit opening (18) or that the reflected fluid jet streams (11) are deflected under an angle, wherein the angle is equal to or flatter as compared to the inclination of the forwardly rising disposed lower screen wall (7), wherein the reflected fluid jet streams (11) arc captured and pass through the exit opening (18) at the surface of the lower screen wall (7);

wherein the lower screen wall (7), which preferably exhibits a planar course, is reaching down to the surface of the processed railtrack (17) and ends in an edge (21) preferably nearly touching at least at a distance from the impingement point (4) of the high-pressure fluid jet streams, wherein the distance corresponds at least approximately to the length of the railtrack groove (3) processed by the high-pressure fluid jet stream;

wherein a groove seal (9) is disposed operating from the edge (21) downwardly into the railtrack groove (3), which groove seal (9), for example, protrudes into the railtrack groove (3), is made of a rigid material, preferably hinged or of elastic or of material not resisting bending, of a wear resistant material, solidly attached or formed by a sealing liquid jet stream.

24. A groove cleaning unit with a high pressure jet nozzle from which a cleaning fluid impinges in a high pressure jet stream inclined downwardly onto a cleaning surface and is covered by a covering screen, wherein an exit opening for the dirt fluid mixture is placed in the cover screen, wherein the cover screen (5) covers a piece of a railtrack (17) with a railtrack groove (3), wherein a high pressure jet nozzle (1) is placed in the region of a front wall (8) on the jet stream side, wherein a high pressure fluid jet stream (2) is directed onto an impingement location (4) in the railtrack groove (3) by the high pressure jet nozzle (1), wherein a reflected fluid jet stream (11) of the high pressure fluid jet stream (2) is reflected under an angle, wherein the angle is steeper as compared to the inclination of a lower screen wall (7) disposed inclined relative to a travel advance direction (19) and is rising forwardly and wherein the reflected fluid jet stream (11) passes essentially immediately to an exit opening (18) or that the reflected fluid jet streams (11) are deflected under an angle, wherein the angle is equal to or flatter as compared to the inclination of the forwardly rising disposed lower screen wall (7), wherein the reflected fluid jet streams (11) are captured and pass through the exit opening (18) at the surface of the lower screen wall (7);

wherein the lower screen wall (7), which preferably exhibits a planar course, is reaching down to the surface of the processed railtrack (17) and ends in an edge (21) preferably nearly touching at least at a distance from the impingement point (4) of the high-pressure fluid jet streams, wherein the distance corresponds at least approximately to the length of the railtrack groove (3) processed by the high-pressure fluid jet stream;

wherein a groove covering (10) disposed running from the edge (21) forwardly in travel direction (19) and essentially sealingly resting on the surface of the railtrack (17) to be processed, wherein the length of the groove covering (10) corresponds to a multiple of the depth of the railtrack (3), in particular at the holding back of the cleaning fluid by the dirt deposits (12) adapted in the railtrack groove (3).

25. A groove cleaning unit with a high pressure jet nozzle from which a cleaning fluid impinges in a high pressure jet stream inclined downwardly onto a cleaning surface and is covered by a covering screen, wherein an exit opening for the dirt fluid mixture is placed in the cover screen, wherein the cover screen (5) covers a piece of a railtrack (17) with a railtrack groove (3), wherein a high pressure jet nozzle (1)

is placed in the region of a front wall (8) on the jet stream side, wherein a high pressure fluid jet stream (2) is directed onto an impingement location (4) in the railtrack groove (3) by the high pressure jet nozzle (1), wherein a reflected fluid jet stream (11) of the high pressure fluid jet stream (2) is reflected under an angle, wherein the angle is steeper as compared to the inclination of a lower screen wall (7) disposed inclined relative to a travel advance direction (19) and is rising forwardly and wherein the reflected fluid jet stream (11) passes essentially immediately to an exit opening (18) or that the reflected fluid jet streams (11) are deflected under an angle, wherein the angle is equal to or flatter as compared to the inclination of the forwardly rising disposed lower screen wall (7), wherein the reflected fluid jet steams (11) are captured and pass through the exit opening (18) at the surface of the lower screen wall (7);

wherein a transport device (14) comprises a bucket chain, wherein the buckets of the bucket chain at the lower half of the conveyor belt or chain, perpendicular to the travel direction (19) are attached movable through under the exit opening (18) of each groove cleaning unit.

26. Groove cleaning unit comprising a high pressure jet nozzle from which an aqueous cleaning liquid impinges in a high pressure jet stream inclined downwardly onto a cleaning surface and is covered by a covering screen, wherein an exit opening for the dirt fluid mixture is placed in the covering screen;

side walls (13) reaching down up to the surface (24) of the railtrack (17) and to a surface of a leading edge (23) on two sides of the railtrack groove (3) and end with sealing beams (25,26), wherein a sealing beam (25) is the disposed resting on a surface (22) of the railtrack (17) essentially laying on the surface (22) and wherein the sealing beam (26) is disposed resting on the surface (24) of the leading edge (23), in the case the high level distance between the surface (22) of the railtrack (17) and of the surface of the leading edge (23) exhibits the highest tolerance value, wherein the two sealing beams (25, 26) delimit the opening of the cover screen (5) sideways relative to the railtrack groove (3) and protrude in the direction of travel (19) on two sides.

* * * * *